US007422142B2

(12) United States Patent
Arippol

(10) Patent No.: US 7,422,142 B2
(45) Date of Patent: Sep. 9, 2008

(54) PACKAGE WITH A RE-SEALABLE CLOSURE FOR OPENING AND CLOSING

(76) Inventor: Giuseppe Jeffrey Arippol, Av. Dracena, 450, Jaguare, 05329-000, São Paulo, SP (BR)

( * ) Notice: Subject to any disclaimer, the term of this patent is extended or adjusted under 35 U.S.C. 154(b) by 585 days.

(21) Appl. No.: 10/876,769

(22) Filed: Jun. 25, 2004

(65) Prior Publication Data

US 2005/0284786 A1 Dec. 29, 2005

(51) Int. Cl.
*B65D 75/08* (2006.01)
*B65D 75/04* (2006.01)

(52) U.S. Cl. ..... 229/87.01; 229/87.08; 229/123.1; 383/211; 206/459.5

(58) Field of Classification Search ..... 206/445, 206/446, 459.5, 484, 807, 830; 229/87.01, 229/87.08, 87.05, 123.1, 92.7, 87.5, 87.2, 229/247, 125.39, 87.09; 383/98, 99, 210, 383/211, 210.1, 203, 204; 40/638
See application file for complete search history.

(56) References Cited

U.S. PATENT DOCUMENTS 1,814,685 A * 7/1931 Glass ..... 383/106
2,327,024 A * 8/1943 Davidson, Jr. et al. ... 229/87.01
2,337,730 A * 12/1943 Berch ..... 229/217
2,349,247 A * 5/1944 Coghill ..... 383/93
3,259,507 A * 7/1966 Smith ..... 426/127
3,386,846 A * 6/1968 Lones ..... 428/42.3
3,411,701 A * 11/1968 Nussbaumer et al. .... 229/87.09
3,518,145 A 6/1970 Christensen
4,300,700 A 11/1981 Chang
4,611,753 A * 9/1986 Kullberg ..... 229/123.1
4,956,962 A 9/1990 Williams
5,051,263 A 9/1991 Barry et al.
5,078,509 A * 1/1992 Center et al. ..... 383/88
5,343,647 A * 9/1994 Bulka ..... 40/630
5,348,400 A * 9/1994 Haiss et al. ..... 383/210
5,405,629 A 4/1995 Marnocha et al.
5,582,853 A 12/1996 Marnocha et al.
5,626,250 A 5/1997 Dorazio
5,639,529 A 6/1997 Gozdecki
5,707,470 A 1/1998 Rajala et al.
5,711,847 A 1/1998 Rajala et al.
5,897,210 A * 4/1999 Giblin et al. ..... 383/98
6,299,355 B1 * 10/2001 Schneck ..... 383/205

(Continued)

OTHER PUBLICATIONS

U.S. Appl. No. 10/938,858, filed Sep. 9, 2004, Arippol.

(Continued)

*Primary Examiner*—Mickey Yu
*Assistant Examiner*—Steven A. Reynolds
(74) *Attorney, Agent, or Firm*—Stattler-Suh PC

(57) ABSTRACT

A re-sealable package includes a closure label and a main body. The closure label has a picking end and an adhesive on a first side of the closure label. The main body has a plastic film formed in a desired shape to generate a wrapping. The main body also has several flaps. The closure label is coupled to the main body so as to attach the closure label to the main body to allow the picking end to extend beyond the main body. The flaps of the package are sealed. Depressing the picking end on a portion of the main body re-seals the package. Embodiments include a method of making the package.

20 Claims, 7 Drawing Sheets

U.S. PATENT DOCUMENTS

| | | | |
|---|---|---|---|
| 6,461,708 | B1 | 10/2002 | Dronzek |
| 6,502,986 | B1 | 1/2003 | Bensur et al. |
| 6,537,401 | B2 | 3/2003 | Couillard et al. |
| 6,540,854 | B2 | 4/2003 | Couillard et al. |
| 6,547,903 | B1 | 4/2003 | McNichols et al. |
| 6,585,153 | B2 | 7/2003 | Ryan |
| 6,594,927 | B2 | 7/2003 | Witkowski |
| 6,613,171 | B2 | 9/2003 | McNichols et al. |
| 6,620,270 | B2 | 9/2003 | Ehlert et al. |
| 6,634,539 | B2 | 10/2003 | Mlinar et al. |
| 6,668,892 | B2 | 12/2003 | Vasilakes et al. |
| 6,676,003 | B2 | 1/2004 | Ehlert et al. |
| 6,685,046 | B2 | 2/2004 | Ogino |
| 6,685,085 | B2 | 2/2004 | Hanna |
| 6,723,360 | B1 | 4/2004 | Dunaway |
| 6,733,855 | B1 | 5/2004 | Scott |
| 7,022,197 | B2 | 4/2006 | Sitzmann |
| 7,025,841 | B2 | 4/2006 | Owen |
| 2003/0056410 | A1 | 3/2003 | Witkowski |
| 2003/0217489 | A1 | 11/2003 | Witkowski |
| 2006/0054268 | A1 | 3/2006 | Sells |

OTHER PUBLICATIONS

U.S. Appl. No. 11/201,022, filed Aug. 9, 2005, Arippol.
U.S. Appl. No. 11/473,216, filed Jun. 21, 2006, Arippol.

* cited by examiner

PACKAGE WITH A RE-SEALABLE CLOSURE FOR OPENING AND CLOSING

BACKGROUND OF THE INVENTION

1. Field of the Invention

The present invention is directed toward the field of packaging, and more particularly toward a re-sealable package for opening and closing.

2. Art Background

It is already known the package intended particularly to pack crackers and comprised, essentially, of a sheet of plastic film of proper size, composed by layers that have specific functions, such as structure, barrier against action of aggressive external agents, as printing base, of thermal sealing made in both faces, among others. The packaging operation using said package is made through high-speed machinery that, in general, performs the following operations: to form a proper stack of crackers, to cut and fold a sheet of package around the stack of crackers, superposing the longitudinal ends of the sheet so as that the sheet length is larger than that of the cracker stack and that the cross ends of the sheet are projected in relation to the ends of the stack of crackers; to carry out the hot sealing operation on the superposed longitudinal ends, fixing the film around the stack of crackers; to make folds at the ends of the sheet, projected beyond the ends of the stack of crackers, so as that, at each end, two first opposite regions of the sheet are held directly on the ends of the stack of crackers, that one of the other two second opposite regions of the sheet is held on said two first opposite regions and that the other second opposite region is held on said opposite second region; and carry out hot sealing operations of said folded ends of the package, so as that, at each end, at least the second of said folds are fixed to each other.

The opening of such type of cracker package by the consumer is made by breaking the hot sealing of one of the folded ends, therefore releasing the other folds, allowing access to the product.

In another possible embodiment of such package type, plastic film sheet incorporates a narrow band, named "tearing tape", which is located close to one of the cross borders and that, when the package is ready, remains around the stack of crackers.

The package opening, in such case, is made by pulling a loose end of the "tearing tape", which breaks the package.

Both package embodiments are proper for the packing of the crackers before the package opening, that is, in the marketing period between the product manufacturing plant and the sale point and between the latter and the final consumer. However, after the opening of the product package and in case the whole contents thereof are not consumed, the package does not provide anymore a proper packaging for the remaining product, generally because of not providing means for a relatively air-tighten closure after the first opening.

Therefore, user has to take improvised measures of closing after the package opening, which does not provided proper protection for the remaining product.

SUMMARY AND OBJECTS OF THE INVENTION

As a result of that, improvements have been introduced in such kind of package, aiming at providing it with any means that allow to close it properly after its opening, so as to provide proper protection for any remaining product, which is not consumed at the time of opening.

Therefore, the purpose of the disposition object hereof is to provide a self-adhesive label that, at an initial time, acts as part of the package opening mechanism and that, at a second moment, after the opening thereof, is taken from the original location and re-applied in a new position, which provides proper closing of the package after its first opening.

Another purpose is to provide a closure label that results in the aforementioned effect, but which can be applied to the package through usual packing equipment without any change.

Another purpose is to provide a closure label that, despite giving the aforementioned advantages, is not, because of those advantages, something with construction, manufacture or application in the package with complexity levels that may turn it non-interesting.

Another purpose is to provide a closure label that provides a cost-effective solution.

Another purpose is to provide a package formed by the closure label.

A package with a re-sealable closure for opening and closing comprises a plastic film cut in the desired shape that, after assembled, configures a thin main body having a different cross section. The closing of the ends of the package occurs by the superposition and temporary joining of flaps, forming a wrapping with an internal packaging cavity, characterized by the fact that the closing flap incorporates a re-sealable closure label, formed by a section provided with temporary adhesive and other section free from such adhesive, configuring therein a picking languet and removal of said closure label.

DETAILED DESCRIPTION

As shown by the figures listed above, label 1, object of this invention patent, is intended to comprise a closure to open and close package 20, preferably of crackers or similar products, formed by a plastic film provided, among others, with hot-sealant layers in both faces.

Figure 14:
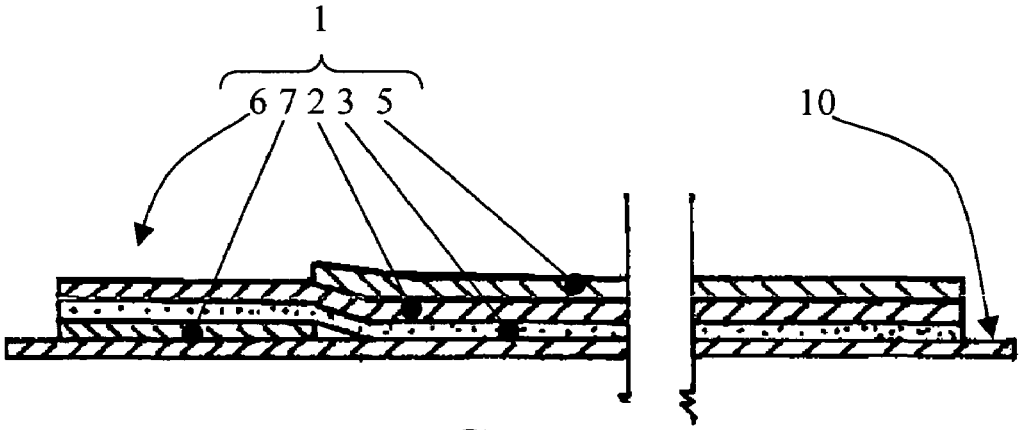

Said closure label 1 is comprised essentially: of a plastic label body 2, which may have any proper relatively extended configuration; of a re-sealable adhesive layer 3, placed at one of the faces of body 2; of a release varnish layer 4, placed on the opposite face of the body 2; and hot sealant varnish layer 5 incorporated on the release varnish layer 4; said label body 2 has an end where the re-sealable adhesive layer 3 is "finished" (FIGS. 2 and 14) or where said layer is not given, forming at that end of body 2 a non-adhesive picking end 6 intended to be pulled by the user to open the package or to detach the label from its original location in the package.

For the purposes of this report, the word "re-sealable", attributed to the adhesive layer 3, shall mean that said adhesive layer may be stuck to and detached from a surface for several times. The word "finished" attributed to a region of layer 3 foreseen at the end of the label body 2 shall mean that the adhesive layer in that region is coated with a non-adherent material layer, such as a layer of varnish or plastic film 7.

Closure label 1 is supplied to the party that applies it on the package adhered on a support tape and silicone-coated paper protection, liner, 10, where the re-sealable layer 3 is adhered, which tape 10 contains several closure labels 1 spaced evenly, and which is supplied in the form of reel or sheets.

Figure 3:
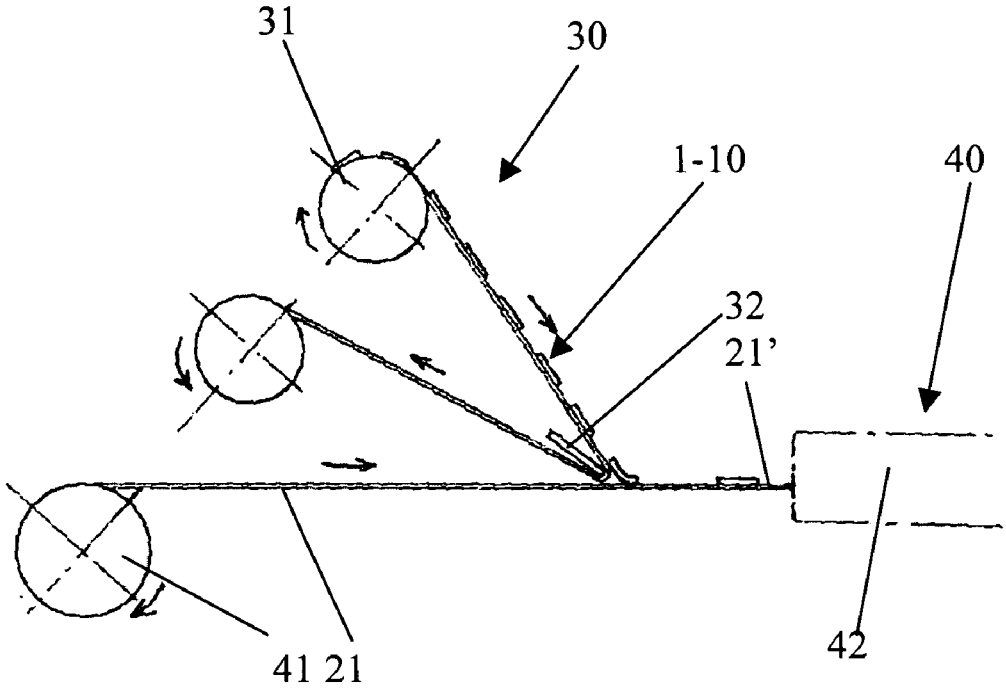
FIG. 3 shows a scheme of an example on how the closure label is applied on a package sheet.
Figure 4:
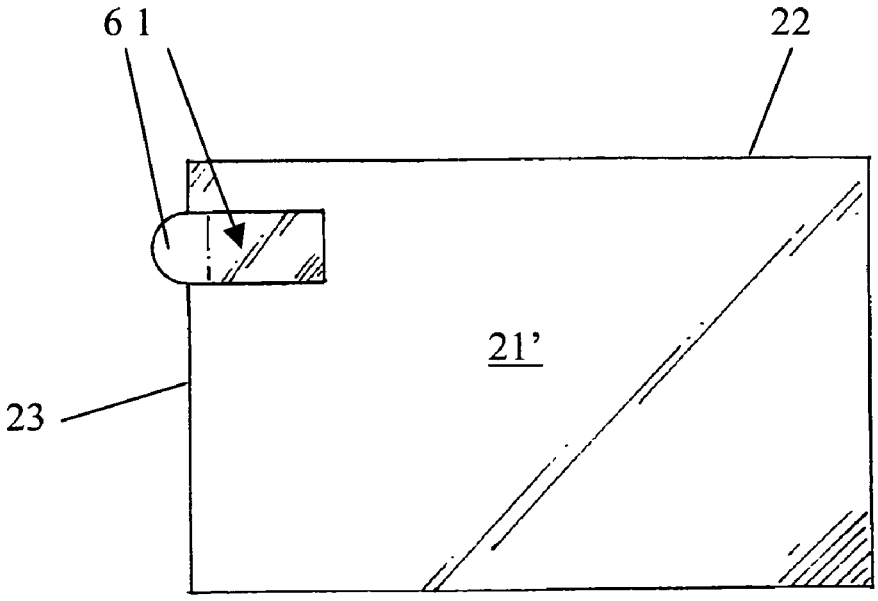
FIG. 4 shows a flat package sheet containing the closure label applied thereon.

Several closure labels 1, as described above (FIG. 3) are applied on a tape 21 of packages in the usual form as self-adhesive articles are applied, that is, for example, through a labeling equipment 30, which may be intercalated before an usual cracker packing equipment 40 or before the station of such equipment that makes the packing itself. Thus, package tape 21 is unwound at an unwinder device 41 of the packing equipment 40. Concurrently, support tape 10 containing the closure labels 1 is unwound at an unwinder 31 of the labeling equipment 30; passes and is folded in a label detaching border 32, located near to the internal surface of a section of the package tape 21 that leaves the unwinder 41, where closure labels 1, in sequence, are detached and adhere, through their re-sealable adhesive layers 3, on the internal surface of the package tape 21, so as that each closure label 1 (FIG. 4) is adhered close to one of the cross borders 22 of a respective section 21' of the package tape 21, which will constitute a package 20, as well as adhered in one of the cross borders 23 of said section of package tape 21' and with the non-adherent picking end 6 projected outside said cross border 23.

Figure 5:
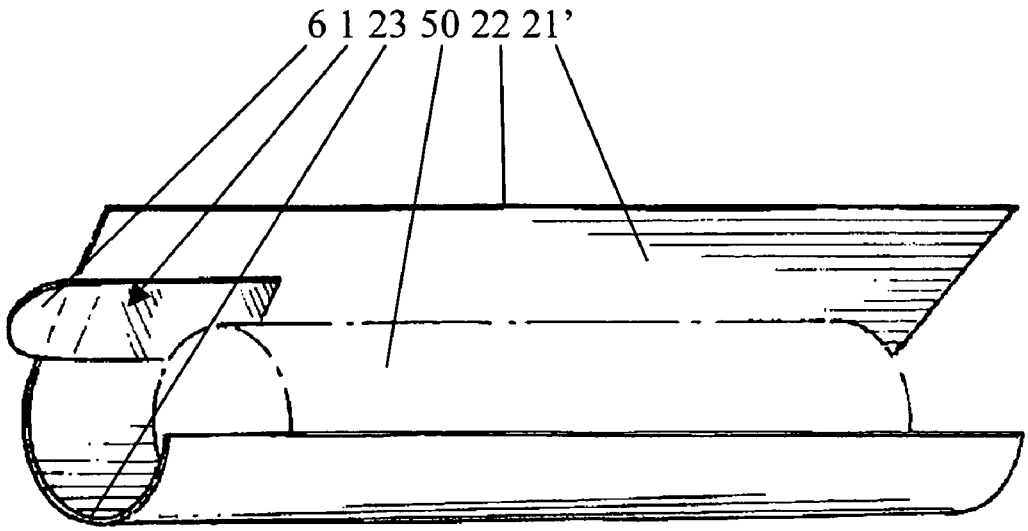
FIG. 5 shows a package containing the closure label being placed around a stack of crackers.
Figure 6:
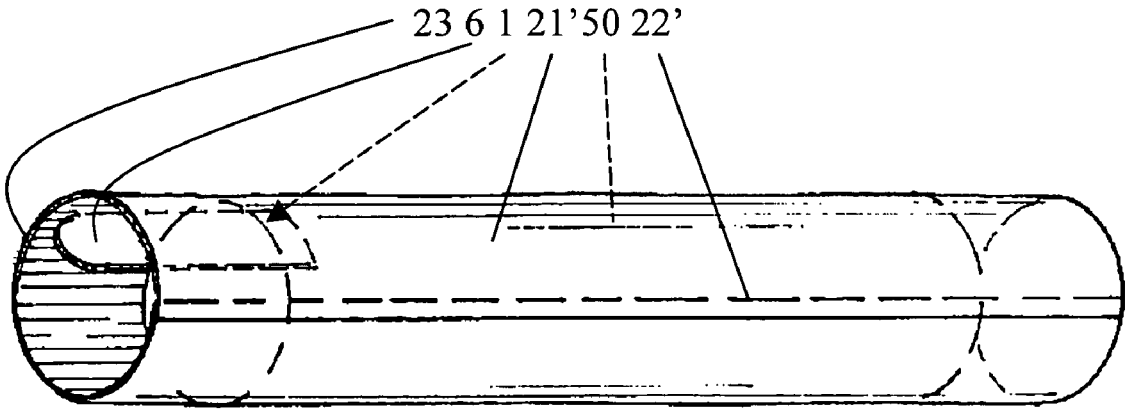
FIG. 6 shows the package already hot sealed longitudinally.
Figure 7:
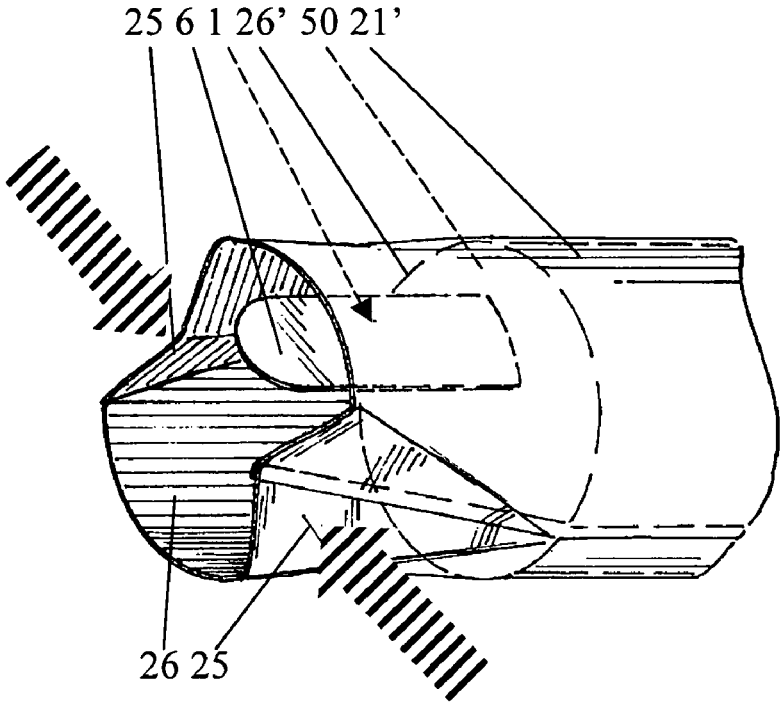
FIG. 7 shows the end of the package that contains the closure label being folded.

Therefore, package tape 21, having closure labels 1 adhered thereon, follows to the other conventional packing stations 42 of equipment 40, which carry out the usual packing stages, that is: state of formation of a stack 50 of crackers, proper to be packed; cutting stage of a package sheet 21' containing one closure label 1 and folding (FIG. 5) of said package sheet 21' containing the closure label 1 around the stack of crackers 50, so as that the longitudinal borders 23 folded and projected in relation to the respective ends of the stack; hot sealing stage of said superposed longitudinal borders (FIG. 6); folding stages of the cross borders 23 of the packing sheet 21' (FIG. 7), located at the package ends, made so that (taking into consideration the end corresponding to the cross border that contains the closure label 1) the first opposite regions 25 of the end of the package sheet 21' are folded and clinched directly over the end of the stack of crackers 50; one of the two other second opposite regions 26 of the end of the package sheet 21', which does not contain the closure label 1, is folded and clinched on said first opposite regions 25 and that the other opposite second region 26', which contains the closure label 1, is folded and clinched on said one opposite second region 26, which does not contain the closure label 1; and hot sealing stage of said package ends.

Figure 8:
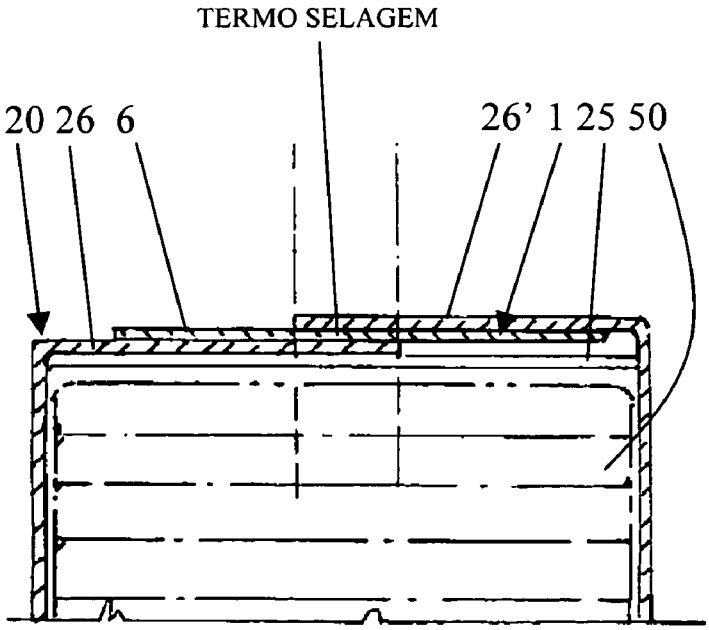
FIG. 8 shows the end of the package that contains the closure label fully folded, in sectional view and indication of the hot sealing zone.

Upon the folding made on the cross border 23 of the package that contains closure label 1, as described above, the second opposite region 26, which does not contain the closure label 1, is under the hot sealant varnish layer 5 of the latter (FIG. 8) so as that when the heat is applied at the hot sealing stage of the package, said second opposite region 26, which does not contain closure label 1, adheres to said hot sealant varnish layer 5 of the latter, concluding the closing.

Therefore, the original closing of the package end, which contains closure label 1, is comprised (FIG. 8): of the first opposite regions 25 folded and clinched on the end of the stack of crackers 50; of the second opposite region 26, which originally did not contain closure label 1, arranged in intermediate position, folded and clinched on the first regions 25; of the closure label 1 adhered through its hot sealant varnish layer 5 to said second intermediate region 26; and of the other second region 26' arranged externally and adhered to the closure label 1 through the re-sealable adhesive layer 3 of the latter, thus concluding the closure, the non-adhesive picking end 6 of said closure label 1 being free, projected to outside under the border of said second external region 26' and superposed to the external surface of the other second intermediate region 26.

Figure 9:
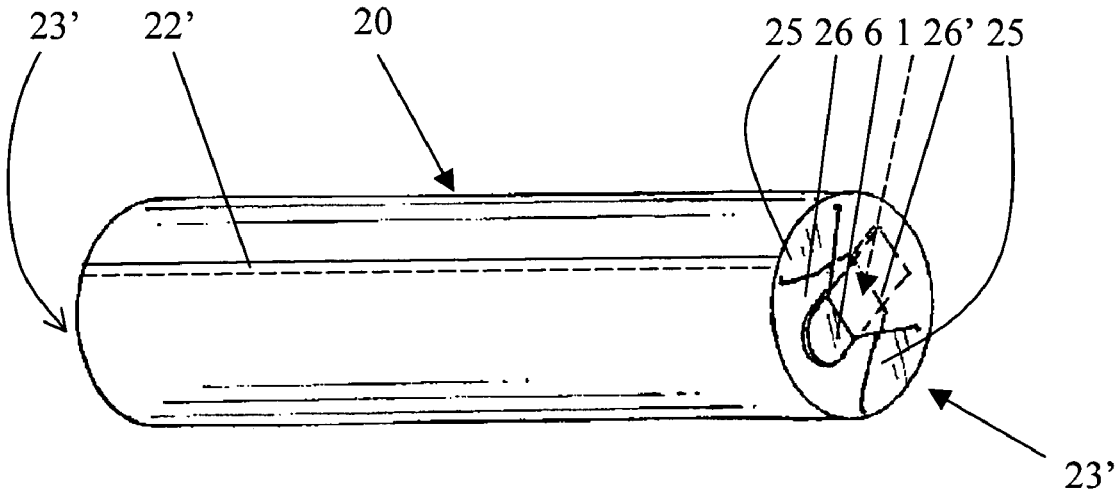
FIG. 9 shows the package containing the closure label ready.
Figure 10:
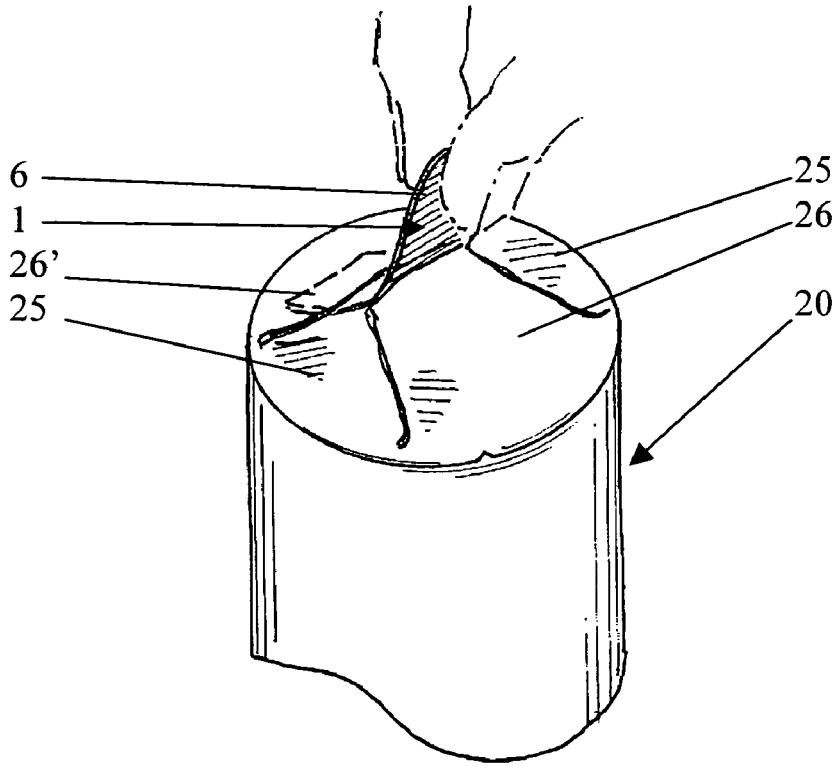
FIG. 10 shows the package with its original closing being opened through the closure label.

In such conditions, package 20 is comprised (FIG. 9) of a cylindrical or prismatic plastic film enclosure (according to the shape of the cracker or similar product) arranged around the stack of crackers 50, provided with a longitudinal closing line 22', comprised of the longitudinal borders of the package sheet, superposed and hot sealed, and of end closures 23', comprised of the cross borders of the package sheet, folded so as to compose superposed and hot sealed folds, one of the package ends being provided with closure label 1 arranged with the end, provided with the layer of re-sealable adhesive 3 and the layers of release varnishes 40 and hot sealant 5, intercalated and adhered between two opposite folds, one external 26' and one intermediate 26, respectively, and the opposite end of closure label 1, non-adhesive picking end 6, being free and projected to outside the stuck folds 26' and 26. In such conditions, for the first opening of package 20 (FIG. 10), user may pick and pull the exposed picking end 6 of closure label 1, after which the layer of hot sealant varnish layer 5, which connects the closure label 1 to the intermediate fold 26, detaches from the release varnish layer 4 connected to the label body 2 and folds 26' and 26 are released and both those folds and folds 25 may be unfolded, upon which the package is opened and the user has access to its contents.

Figure 11:
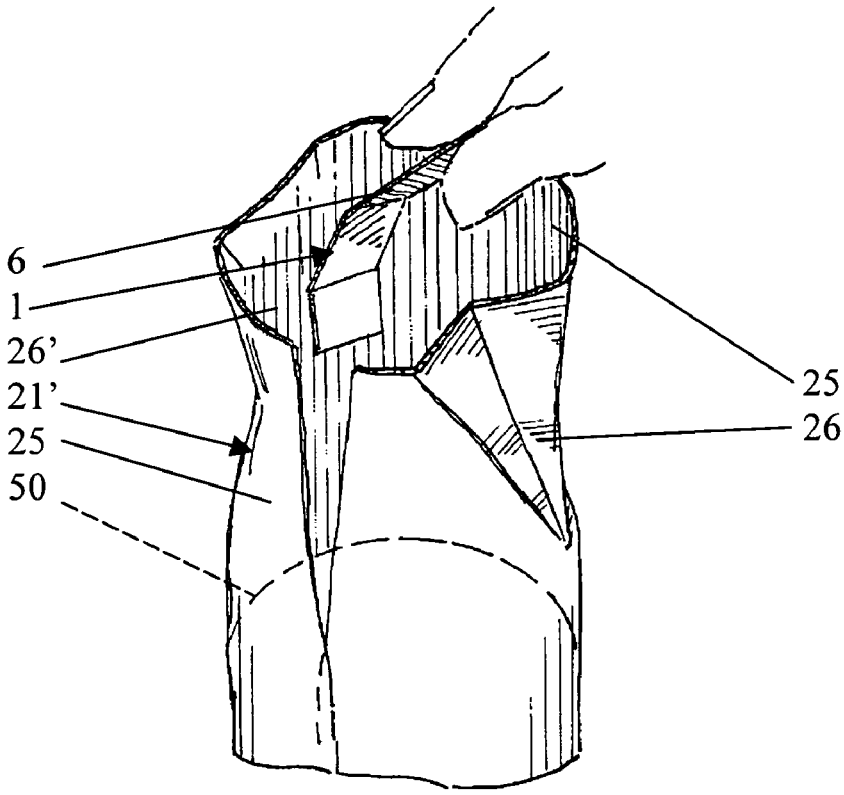
FIG. 11 shows the closure label being taken from the original location after the package opening.
Figure 12:
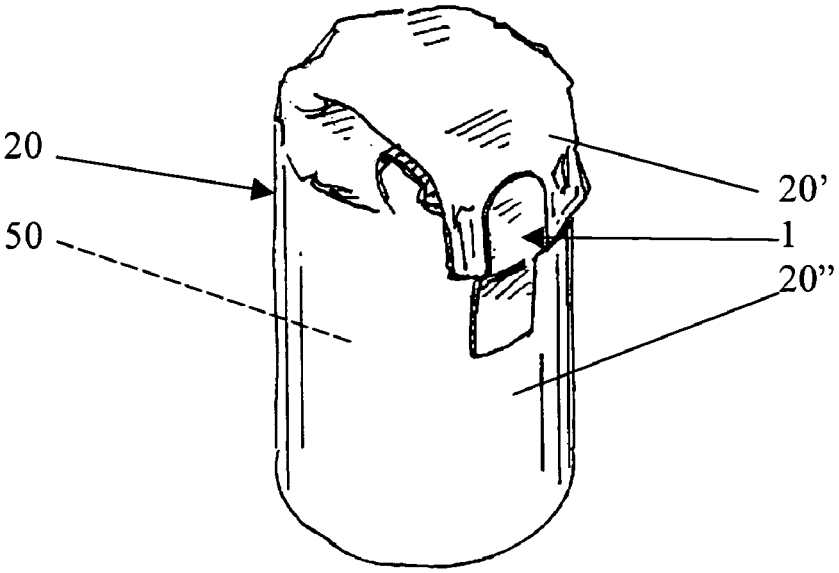
FIG. 12 shows the package being closed again, after the opening, through re-application of the closure label in another location.

In case the user does not consume the whole contents of the package and wants to close it again, closure label 1 may be pulled again and may have its re-sealable adhesive layer 3 unstuck from the internal surface of the external fold 26' (FIG. 11). Thereafter, the empty portion 20' of the package may be folded and superposed to the full portion 20" and both parties may be joined which other through the closure label 1 stuck through its re-sealable adhesive layer 3, thus closing the package again so as to protect its remaining contents (FIG. 12).

Therefore, this closure label 1 settles the problems and limitations of the usual closure means of packages for crackers and similar products 20, of the type formed by plastic film enclosure, since it acts as part of the original closing system of the package; it allows and makes easier the package opening through its picking end 6; and also allows it to be removed from its original position in the package and, in case the package contents are not fully consumed, to be re-applied in another position, which allows new closing of the package after it being opened and proper protection of its remaining contents.

Another advantage of this closure label 1, as already seem, is the fact that it can be applied on the package without changing the usual packing equipment 40 of package formation, it being enough only the juxtaposition of said equipment 40 to a labeler-type label application equipment 30.

Another advantage of this closure label is the fact that it does not present construction, manufacture or cost that makes it improper in view of the ideal cost-benefit ratio of the package.

Another advantage is that the package itself is provided with the closure label, which is more practical and effective than the others.

Within the basic construction described above, the closure label object of this invention patent, as well as the package to which it is intended, may present changes related to materials, dimensions, constructive and/or functional configuration and/or decorative details, without deviating from the scope of the requested protection.

In view of that, the closure label may be rectangular or may have other shapes, according to the application, which are proper to its actuation mentioned above.

Closure label may have body 2 comprised of a polymer or a composition of laminated or co-extruded polymers or others. Examples of proper polymers are polymers similar but not limited to: polyester, polypropylene and polyethylene. A specific example of a proper material for a label body is polyester, proper but not limited to 66.1/36 or 19.10/23 of Terphane Company.

The re-sealable adhesive layer 3 may comprise one of the commonly used adhesives. For example, the pressure-sensitive adhesive may be a water-based acrylic adhesive or solvent-based acrylic adhesive (type methyl metacrylate copolymer with butyl acrylate) or adhesive based on hot-melt rubber. The adhesive may be applied by methods that provide a controlled quality standard.

The hot sealant varnish layer 5 is preferably a hot sealable permanent adhesive, the composition of which consists essentially of a vinyl of vinylidene copolymer, a polymer or copolymer of acrylic esther or polyester resin obtained by condensation.

The release varnish layer 4 is preferably a varnish with low affinity to adhesives, the composition of which is basically or acrylic and/or vinyl resins and/or polyester by-products, with silicone parts.

Figure 1:
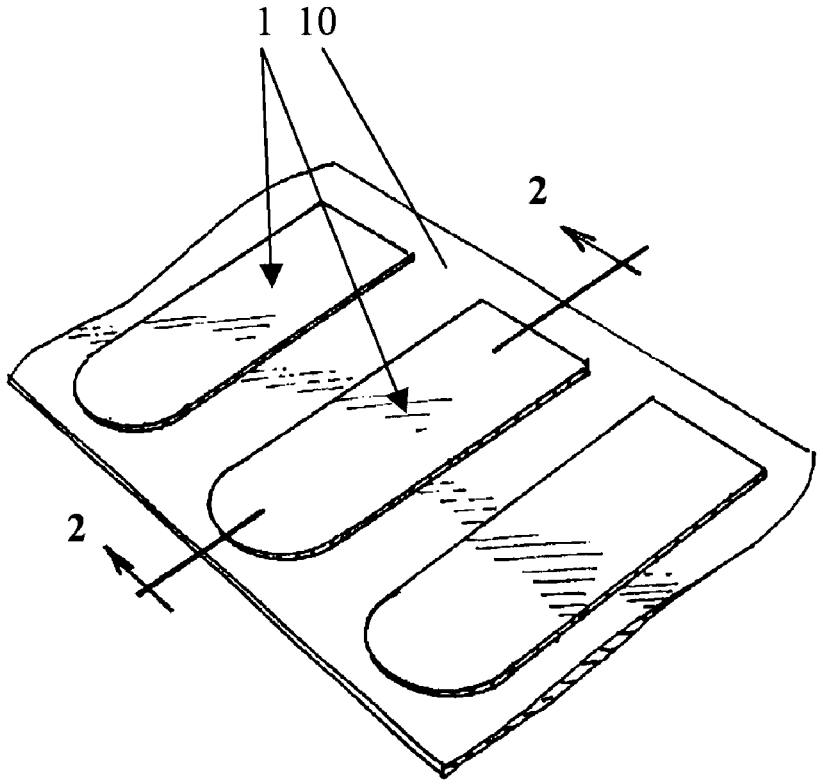
FIG. 1 shows the closure label taken separately and the indication on how it is supplied to its applier in the package.
Figure 2:
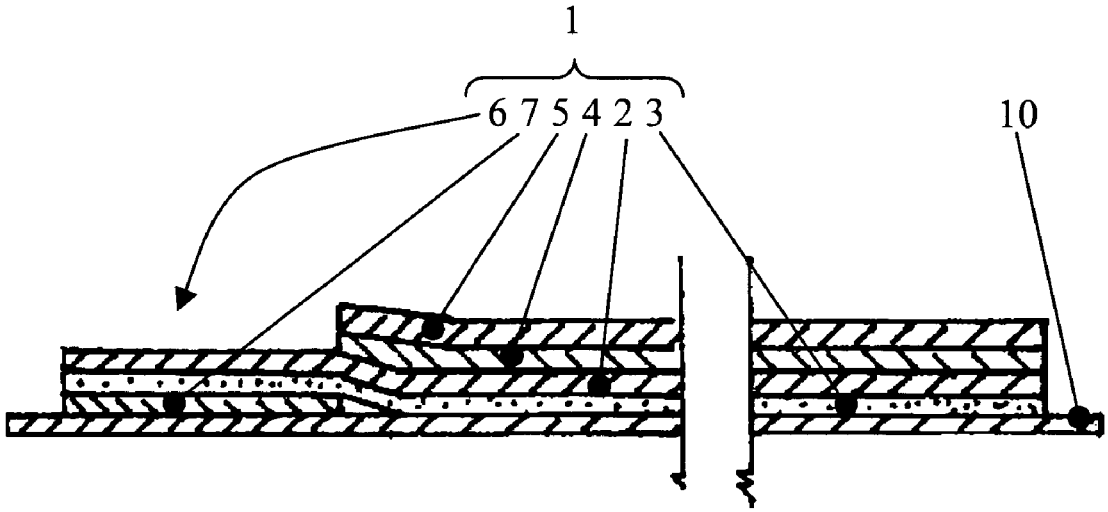
FIG. 2 shows a cross section of a possible embodiment of the closure label.
Figure 13:
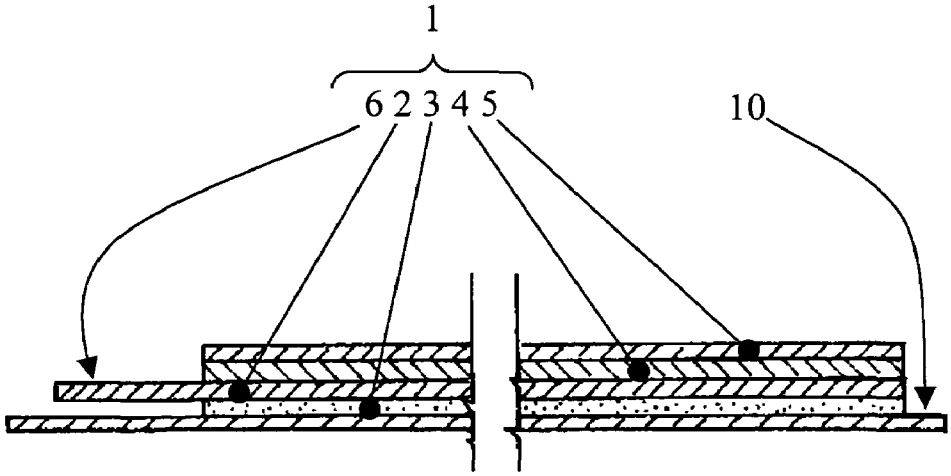
FIGS. 13-15 show sectional views of other possible embodiments of the closure label.

Closure label 1 may be comprised, as seem above: of a label body 2; of a re-sealable adhesive layer 3 given in one of the faces of body 2 and that, in one of the ends of said layer, may be omitted, as shown in FIG. 13, or may be provided and "finished" with varnish or plastic film layer 7, according to FIG. 2, in order to compose no-adherent picking end 6 to the user pull the label in the package opening or to remove it from the package; said closure label is also provided with: release varnish 4, given in the opposite face of body 2, and hot sealant layer 5 given on the release layer.

Figure 15:
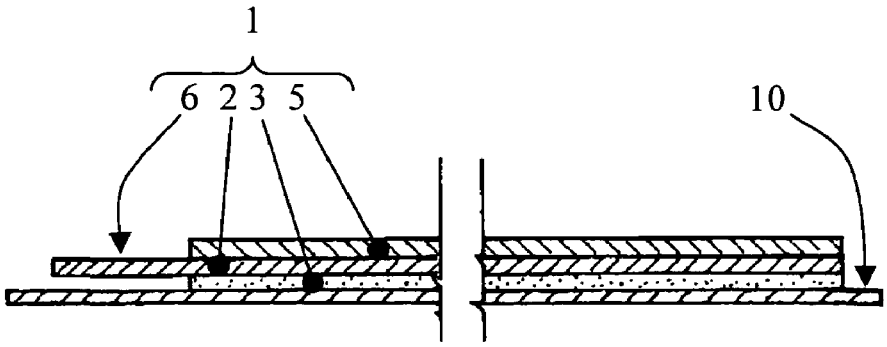

In another possible embodiment, closure label 1 may be comprised: of body 2; of re-sealable adhesive layer 3 given in one of the faces of body 2; of end of body 2 provided with adhesive layer "finished" with a varnish or plastic film layer 7 in order to compose the picking end 6 (FIG. 14) or said end of the label body 2 being not provided with re-sealable adhesive layer in order to compose the picking end 6 (FIG. 15).

Closure label 1 may either not contain or contain any proper printing layer.

Package 20, where the closure label 1 is applied, is comprised of a plastic film, which may be composed by layers with any specific functions, such as: structure; barrier against aggressive external agents; printing base, printing; of hot sealing in both external faces, among others, and may be applied to other product types, than crackers, which have tablet form.

Although the present invention has been described in terms of specific exemplary embodiments, it will be appreciated that various modifications and alterations might be made by those skilled in the art without departing from the spirit and scope of the invention.

What is claimed is:

1. A method for generating a re-sealable package, said method comprising:

cutting a plastic film in a desired shape to form a main body;

applying a first adhesive layer to a closure label, said closure label comprising:

a picking first end having a first surface and a second surface, wherein the first and second surfaces of the picking first end are non adhesive; and a second end comprising a plurality of layers, including:

said first adhesive layer comprising a resealable adhesive;

a second sealant layer deposed along the adhesive layer for preventing unintended contact of a surface of the package with the adhesive layer, the sealant layer terminating at a border between the picking first end and the second end such that the sealant layer does not extend into the picking first end;

third intermediate layer deposed between the sealant layer and the adhesive layer, the intermediate layer extending into the picking first end;

a fourth release layer deposed along the sealant layer, along a portion of the intermediate layer, and deposed along a portion of the adhesive layer, the release layer comprising a low affinity to adhesives;

attaching said closure label to said main body so as to allow said picking end to extend beyond said main body;

folding said main body to form a wrapping comprising a plurality of flaps, such that said closure label is attached to said flaps; and sealing said package so that said picking end of said closure label is exposed.

2. The method of claim 1, further comprising:

applying pressure on said picking end to remove said picking end from said main body;

removing contents from said wrapping; and re-sealing said package by depressing said picking end on a portion of said main body.

3. The method of claim 1, wherein attaching said closure label to said main body comprises applying a hot seal process to said closure label and said plastic film of said main body.

4. The method of claim 1, wherein folding said main body to form a wrapping comprises folding said main body to generate four flaps.

5. A re-sealable package comprising a closure label comprising:

a picking first end having a first surface and a second surface, wherein the first and second surfaces of the picking first end are non adhesive; and a second end comprising a plurality of layers, including:

a first adhesive layer comprising a resealable adhesive;

a second sealant layer deposed along the adhesive layer for preventing unintended contact of a surface of the package with the adhesive layer, the sealant layer terminating at a border between the picking first end and the second end such that the sealant layer does not extend into the picking first end;

a third intermediate layer deposed between the sealant layer and the adhesive layer, the intermediate layer extending into the picking first end; and a fourth release layer deposed along the sealant layer, along a portion of the intermediate layer, and deposed along a portion of the adhesive layer, the release layer comprising a low affinity to adhesives;

the re-sealable package further comprising a main body comprising a plastic film formed in a desired shape to generate a wrapping, said main body comprising a plurality of flaps, said closure label being coupled to said main body so as to attach said closure label to said main body to allow said picking end to extend beyond said main body.

6. The package of claim 5, wherein said picking end is configured to be removed from said main body, such that a pressure applied to said picking end loosens said plurality of flaps, thereby providing an opening at an end of said package, such that contents of the package, are accessible.

7. The package of claim 5, wherein said picking end comprises a non adhesive material, wherein resealing said package comprises using said picking end to apply an adhesive portion of said closure label to one or more of said flaps.

8. The package of claim 5, wherein attaching said closure, label to said main body comprises applying a hot seal process to said closure label and said plastic film of said main body.

9. The package of claim 5, further comprising four flaps, wherein when said four flaps are sealed, said picking end extends at an exterior portion of one of said four flaps.

10. A label configured to create a closure for a package, the label comprising:

a picking first end having a first surface and a second surface, wherein the first and second surfaces of the picking first end are non adhesive; and a second end comprising a plurality of layers, including:

a first adhesive layer comprising a resealable adhesive;

a second sealant layer deposed along a portion of the adhesive layer for preventing unintended contact of a surface of the package with the adhesive layer, the sealant layer terminating at a border between the picking first end and the second end such that the sealant layer does not extend into the picking first end;

a third intermediate layer deposed between the sealant layer and the adhesive layer, the intermediate layer extending into the picking first end; and a fourth release layer deposed along the sealant layer, along a portion of the intermediate layer, and deposed alone a portion of the adhesive layer, the release layer comprising a low affinity to adhesives.

11. The label of claim 10, wherein the sealant layer is sealed by using heat.

12. The label of claim 10, wherein the sealant layer is arranged directly on the intermediate layer.

13. The label of claim 10, wherein the sealant layer is adjacent to a release layer.

14. The label of claim 10, wherein the adhesive layer is exposed at a portion of the second end.

15. The label of claim 10, wherein the adhesive layer is not exposed at the picking first end.

16. The label of claim 10, wherein the picking first end comprises a non adhesive varnish.

17. The label of claim 10, wherein the picking first end comprises a non adhesive film.

18. The label of claim 10, wherein the package comprises a plastic film wrapped around contents of the package.

19. The label of claim 18, wherein the contents of the package comprise a stack of crackers.

20. The label of claim 10, wherein the release layer comprises one or more of a resin, an acrylic, a vinyl, a polyester, and a silicone.

* * * * *